US008430771B1

(12) United States Patent
Berghammer et al.

(10) Patent No.: US 8,430,771 B1
(45) Date of Patent: Apr. 30, 2013

(54) SPORTS EVENT ADVERTISING DISPLAY SYSTEM

(75) Inventors: Joseph J. Berghammer, Evanston, IL (US); Jonathan Pieter van Es, Irvine, CA (US)

(73) Assignee: Allstate Insurance Company, Northbrook, IL (US)

( * ) Notice: Subject to any disclaimer, the term of this patent is extended or adjusted under 35 U.S.C. 154(b) by 0 days.

(21) Appl. No.: 13/469,542

(22) Filed: May 11, 2012

Related U.S. Application Data

(62) Division of application No. 12/550,275, filed on Aug. 28, 2009, now abandoned.

(51) Int. Cl.
*A63B 63/00* (2006.01)
*G09F 17/00* (2006.01)

(52) U.S. Cl.
USPC ..... 473/477; 473/478; 40/604

(58) Field of Classification Search ..... 273/395, 273/396, 398–402; 473/434, 435, 476–478, 473/454; 40/602, 604, 606.18, 598, 606.03, 40/606.19, 615, 617
See application file for complete search history.

(56) References Cited

U.S. PATENT DOCUMENTS

| | | | | |
|---|---|---|---|---|
| 3,672,672 | A | 6/1972 | Rubin | |
| 3,964,197 | A | 6/1976 | Tucker et al. | |
| 4,165,576 | A | 8/1979 | Joselevich | |
| 4,906,503 | A | 3/1990 | De La Cruz et al. | |
| 4,921,257 | A | 5/1990 | Heller | |
| 5,177,890 | A | 1/1993 | Hisatomi et al. | |
| 5,280,904 | A | 1/1994 | Rodriguez | |
| 5,307,578 | A | 5/1994 | Fichtenau | |
| 5,342,021 | A | 8/1994 | Watson | |
| 5,393,437 | A | 2/1995 | Bower | |
| 5,441,239 | A | 8/1995 | Watson | |
| 5,630,589 | A | 5/1997 | Adie et al. | |
| 5,964,070 | A | 10/1999 | Redl et al. | |
| 6,299,554 | B1 * | 10/2001 | Sinclair et al. | 473/435 |
| 6,688,026 | B1 | 2/2004 | Clark | |
| 6,811,501 | B2 | 11/2004 | Kuzia et al. | |
| 6,986,915 | B2 | 1/2006 | Bourdages | |
| 7,117,619 | B1 | 10/2006 | Huber | |
| 2002/0092218 | A1 | 7/2002 | Black | |
| 2002/0115508 | A1 | 8/2002 | Bourdages | |

(Continued)

FOREIGN PATENT DOCUMENTS

| | | |
|---|---|---|
| DE | 3822422 | 1/1990 |
| DE | 4113481 | 11/1991 |

(Continued)

OTHER PUBLICATIONS

Spagnoli, L., "Sign of the Times", Philadelphia Citypaper, Naked City, Aug. 1-24, 2000:1-2 Downloaded http://citypaper.net/articles/081700/nc.signs.shtml?print=1.

(Continued)

*Primary Examiner* — Mark Graham
(74) *Attorney, Agent, or Firm* — Banner & Witcoff, Ltd.

(57) ABSTRACT

A netting apparatus adapted to display advertising content at a sporting event is disclosed. The netting apparatus comprises a first panel and a second panel. The first panel may comprise an open mesh netting, wherein the open mesh netting is adapted to safely stop a ball without significant obstruction of view through the open mesh netting.

17 Claims, 9 Drawing Sheets

U.S. PATENT DOCUMENTS

| | | | | |
|---|---|---|---|---|
| 2004/0157687 | A1 | 8/2004 | Bourdages | |
| 2006/0105865 | A1 | 5/2006 | Bourdages | |
| 2006/0128238 | A1 | 6/2006 | Arnold et al. | |
| 2007/0082763 | A1 | 4/2007 | Esser | |
| 2007/0090601 | A1* | 4/2007 | Liao | 273/396 |
| 2008/0067751 | A1* | 3/2008 | Hunt | 273/396 |
| 2009/0176603 | A1 | 7/2009 | Prince | |

FOREIGN PATENT DOCUMENTS

| | | |
|---|---|---|
| DE | 4209105 | 9/1993 |
| EP | 0231719 | 8/1987 |
| EP | 1241654 | 9/2002 |
| GB | 2323390 | 9/1998 |
| JP | 05106372 | 4/1993 |
| JP | 06149158 | 5/1994 |
| JP | 08129339 | 5/1996 |
| JP | 08190355 | 7/1996 |
| JP | 10031442 | 2/1998 |
| JP | 10049089 | 2/1998 |
| WO | 2007051885 | 5/2007 |

OTHER PUBLICATIONS

"IHL Test Goal Ads with Free Powerade Display in Finals", Street & Smith's Sports Business Daily, Jun. 5, 1998:1 Downloaded http://www.sportsbusinessdaily.com/index.cfm?fuseaction=archive.printArticles&articleId-32403.

Beane, M., et al., "Clear Directions", Panstadia International Quarterly Report, Article code: 61-046, 1999, 6:1, p. 1-5 Downloaded http://panstadia.com/textfiles/61 texthtm1/61-046.htm.

Zegnal, J., "Ad Firm, City Quarrel Over Use of Scaffoling Net for Advertising", Budapest Business Journal, Factiva, Inc., Jan. 28, 2002:1-2.

"Billboards Going Atop Fenway's Green Monster", The Associated Press State & Local Wire, Jul. 11, 2002:1.

"Nonwovens . . . Engineered Fabric Solutions", Inda Nonwovens Glossary, Inda Association of the Nonwoven Fabrics Industry, 2002:1-5.

"About Nonwovens", Inda Association of the Nonwoven Fabrics Industry, 1997/2009:1 Downloaded http://inda/org/about/nonwovens.html.

Hunt, W., "Theme Parks & Entertainment Environments", Urban Graphics Entertainment, Madison Square Press, 1997:1-3.

Bass, J., "Major League Soccer Stadium Graphics", Treehouse Design Parternship, 164-167.

U.S. Office Action related in U.S. Appl. No. 12/618,392; dated Sep. 6, 2011.

U.S. Office Action related in U.S. Appl. No. 13/215,827; dated Oct. 20, 2011.

* cited by examiner

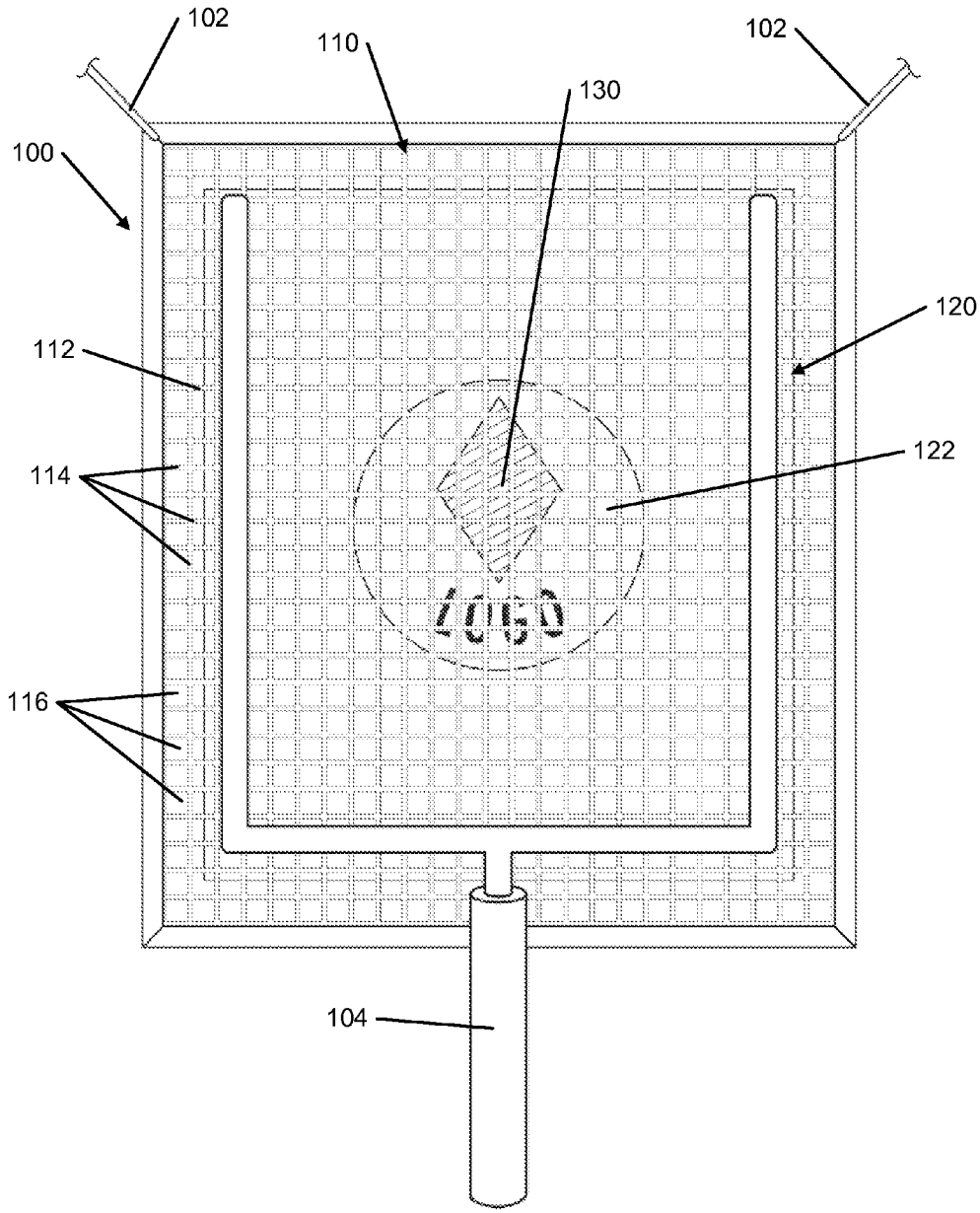
FIG. 1B1

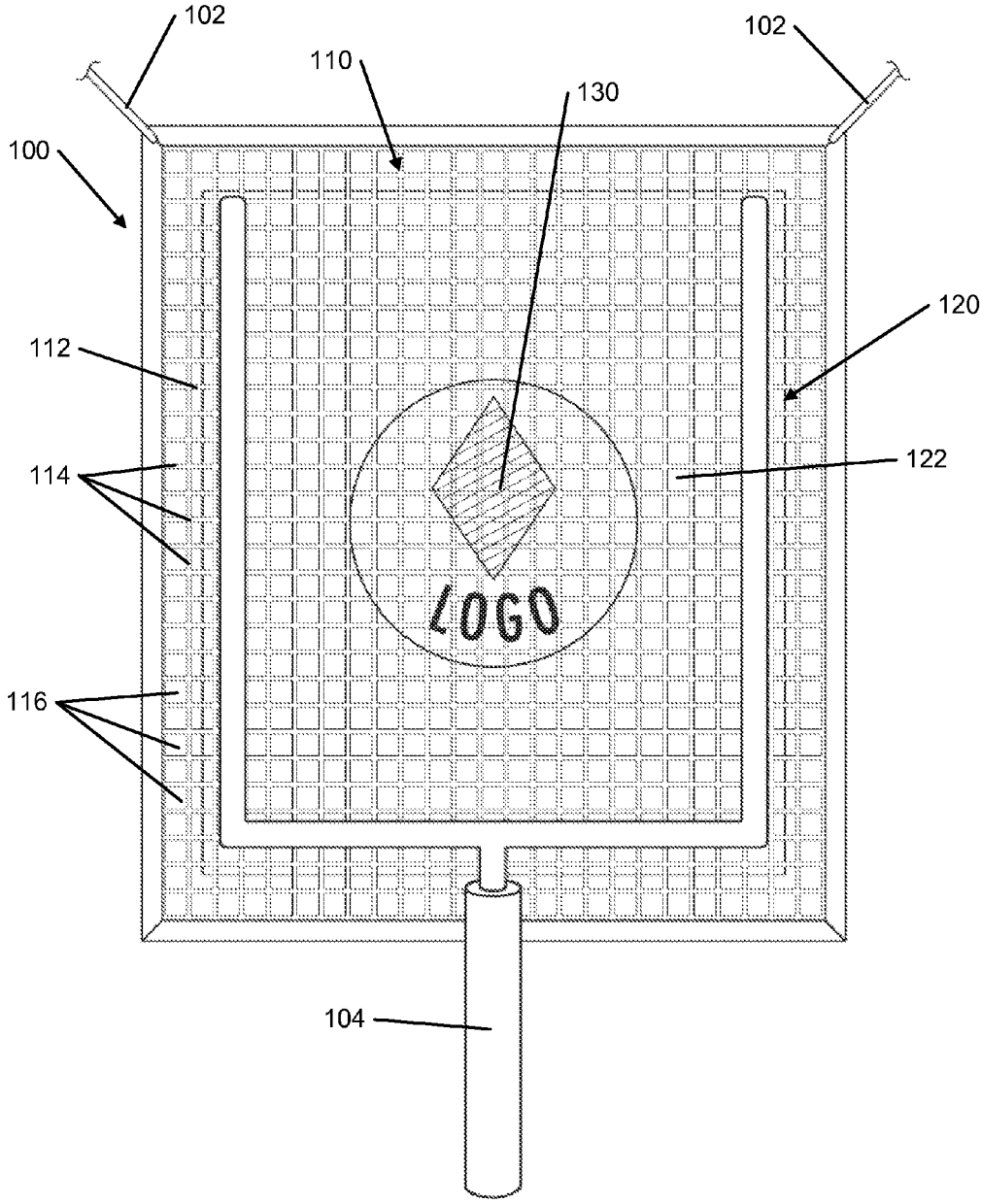
FIG. 1B2

SPORTS EVENT ADVERTISING DISPLAY SYSTEM

This patent application is a divisional application of U.S. application Ser. No. 12/550,275 filed Aug. 28, 2009 and is incorporated herein by reference in its entirety.

FIELD OF THE INVENTION

The present invention is directed towards an apparatus for netting at sporting events, more specifically towards an apparatus for netting that will stop balls at a sporting event and further adapted to display advertising content.

BACKGROUND

Protective netting is commonly used at sporting events to protect spectators from sporting objects, such as balls or other equipment, being thrown or kicked from an athletic field. The protective netting is typically suspended by a plurality of cables from the ceiling within an enclosed stadium, or in the alternative, stretched and attached between a plurality of frame structures within a stadium. The protective net generally comprises a wide mesh such that the spectators in the stadium retain a substantially unobstructed view of the goal or field of play upon which the sporting actions may occur.

Additionally, the dimensions of the openings of the mesh will vary according to whether the protective net is designed to block or prevent the passage of small objects, such as hockey pucks or baseballs, or larger objects, such as footballs. Objects such as hockey pucks, baseballs, or footballs may be herein described as sporting equipment.

While much attention has been given to the protection of spectators at a sporting event through the provision of safety nets, there has been minimal attention given to the displaying of advertising content on these same safety nets.

BRIEF SUMMARY OF THE INVENTION

The following presents a general summary of aspects of the invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

In an aspect of the present invention, a netting apparatus adapted to display advertising content at a sporting event comprises a first panel and a second panel. The first panel may comprise an open mesh netting, wherein the open mesh netting is adapted to safely stop a ball without significant obstruction of view through the open mesh netting. The second panel may comprise a solid material, wherein the solid material is located either in front of the first panel or behind the first panel. Additionally, the solid material may be a nonwoven fabric or a nylon. The second panel may be see-through or not see-through. The second panel may be attached to the first panel. The second panel may be a solid color. The first panel may be painted or colored with a logo. The second panel may be painted or colored with a logo. Additionally, the first panel may be painted or colored with a first logo and the second panel may be painted or colored with a second logo such that the second logo matches the first logo on the first panel.

In another aspect of this invention, a netting apparatus adapted to display advertising content at a sporting event comprises a net and a solid material. The net may comprise an open mesh netting with a cut-out portion, wherein the open mesh netting is adapted to safely stop a ball without significant obstruction of view through the open mesh netting. The solid material may be attached to the net and located inside the cut-out portion of the net such that the net and the solid material do not overlap each other. The solid material may be painted or colored with a logo. The solid material may be a nonwoven fabric or nylon.

In another aspect of this invention, a net apparatus adapted to display advertising content at a sporting event comprises a first net and a second net. The first net may have a first mesh netting with strands which define a plurality of first-sized mesh openings. The second net may have a second mesh netting with strands which define a plurality of second-sized mesh openings. The first-sized mesh openings may be the same size as the second-sized mesh openings. The second net may be located either in front of or behind the first net in an offset manner, such that the strands from the first net cover the mesh openings from the second net and the strands from the second net cover the mesh openings from the first net. The first mesh netting and the second mesh netting each are adapted to safely stop a ball without significant obstruction of view through the mesh nettings.

In another aspect of this invention, a netting apparatus adapted to display advertising content at a sporting event comprises a first net and a second net. The first net may have a mesh netting with strands which define a plurality of first-sized mesh openings. The second net may have a mesh netting with strands which define a plurality of second-sized mesh openings, wherein the second-sized mesh openings may be smaller than the first-sized mesh openings. The first net may comprise a cut-out portion wherein the second net is attached to the first net and located inside the cut-out portion of the first net. The second net may be painted or colored with a logo. The cut-out portion may be located in the middle area of the first net. When the second net is attached to the first net, the first net is on the periphery and the second net is located in the middle.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein:

FIG. 1B1 illustrates a front plan view of another example netting apparatus in accordance with this invention;

FIG. 1B2 illustrates a front plan view of another example netting apparatus in accordance with this invention;

FIG. 2 illustrates a front plan view of another example netting apparatus in accordance with this invention;

Figure 1A:
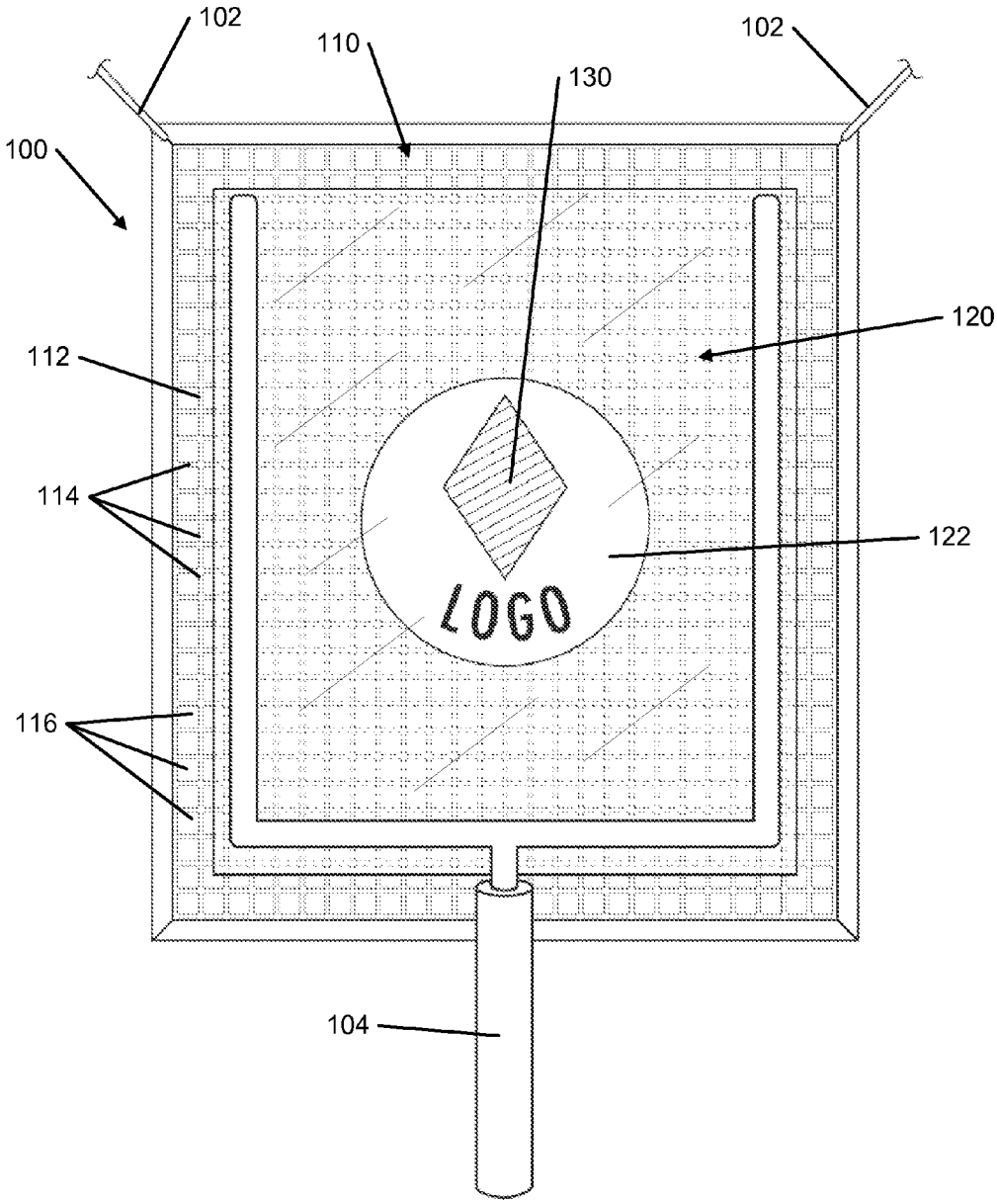
FIG. 1A illustrates a front plan view of an example netting apparatus in accordance with the present invention.

The reader is advised that the attached drawings are not necessarily drawn to scale.

DETAILED DESCRIPTION OF THE INVENTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

FIGS. 1A, 1B1, and 1B2 illustrate a netting apparatus 100 for use at a sporting event that may display advertising content. The netting apparatus 100 may be used for the protection of spectators from sporting objects, such as balls or other equipment, from being thrown or kicked from an athletic field. The netting apparatus 100 may be suspended by a plurality of cables 102 from the ceiling within an enclosed stadium, or in the alternative, stretched and attached between a plurality of frame structures within a stadium. The netting apparatus 100 may be a permanent netting structure within the stadium or sporting event, such as the netting behind home plate at a baseball game. Additionally, the netting apparatus 100 may be a temporary structure used at specific times during a sporting event, such as the netting that is raised behind the field goal posts 104 when a field goal or extra point is kicked in a football game. In one example in accordance with this invention, the netting apparatus 100 is generally comprised of a first panel 110 and a second panel 120. The first panel 110 may comprise an open mesh netting 112. The second panel 120 may comprise a solid material 122.

The first panel 110 includes an open mesh netting 112 that may include strands 114 or threads. The strands 114 may consist of textile fibers, metal, plastics, or other materials. The strands 114 define a plurality of mesh openings 116. The mesh openings 116 may be sized such that the open mesh netting 112 is adapted to safely stop a ball or other object without significant obstructions of view through the open mesh netting 112.

The second panel 120 includes a solid material 122. The second panel 120 may be located either directly in front of the first panel 110 (as illustrated in FIG. 1A) or directly behind the first panel 110 (as illustrated in FIGS. 1B1 and 1B2). Additionally, the second panel 120 may be attached to the first panel 110 by a variety of methods such as sewn together, clipped with fasteners, or any other similar method used to attach the first panel 110 to the second panel 120. The second panel 120 may be see-through, such that the spectators are able to significantly view the sporting event or sports activities through the second panel 120 when the second panel 120 is in position. The second panel 120 may also be not significantly see-through, such that the spectators are not able to significantly view the sporting event or sports activities through the second panel 120 when the second panel 120 is in position.

The solid material 122 of the second panel 120 may consist of a nonwoven fabric. In an embodiment the nonwoven fabric may be formed from lyocell fibers, polyester fibers, polypropylene fibers, rayon fibers or a blend of one or more of these fibers. Lyocell fibers may be included in the nonwoven fabric due to the high strength, both wet and dry, as well as their resistance to wrinkles, superior draping properties and dyeability. The nonwoven fabric may be manufactured through chemical, mechanical or physical bonding, in certain embodiments.

Nonwoven fabrics generally provide specific advantages and functions such as absorbency, liquid repellency, resilience, stretch, softness, strength, washability, and filtering. The use of a nonwoven fabric as the solid material 122 of the second panel 120 provides many benefits for the intended use. The absorbency of the nonwoven fabric is beneficial for coloring or printing the logos 120 on the netting apparatus 100, such that the pigments may be absorbed and retained within the nonwoven fabric. The resilience, stretch, and strength characteristics of the nonwoven fabric may be beneficial for hanging the netting apparatus 100, as well as for providing a durable, long-lasting netting apparatus 100. Additionally, the strength and stretch of the nonwoven fabric may be beneficial for stopping, blocking, and/or deflecting footballs, baseballs, hockey pucks or the like. Additionally, the resilience of the nonwoven fabric may be beneficial because the netting apparatus 100 may be stored between plays and/or games and the ability of the netting apparatus to spring back after being crushed, wrinkled, or stored will help preserve the aesthetic look of the netting apparatus 100. In an embodiment, the nonwoven fabric does not exhibit visible wrinkles to spectators sitting in a football stadium when the nonwoven material is used in connection with a football net despite the nonwoven material having been stored for a day or more prior to being visible to the spectators. The liquid repellency of the nonwoven fabric is beneficial when the netting apparatus 100 is located outside where it may be raining or wet. The washability of the nonwoven fabric will help preserve the aesthetic look of the netting apparatus 100, while also prolonging the life of the netting apparatus 100.

In an embodiment, the nonwoven material has sufficient strength, both wet and dry, to not tear when contacted by a football, hockey puck or other sports equipment as such equipment is typically used in a sporting event. In various embodiments, the nonwoven material will have a texture that simulates suede, leather or silk. In a particular embodiment, the texture of the nonwoven material simulates leather.

In an alternative example of the solid material 122 of the second panel 110 in accordance with this invention, the solid material 122 may include small cut portions or holes. These cut portions or holes may provide a means for air and wind to flow through the solid material 122. The cut portions may be slits of various shapes in the net, or may be in the form of holes. Because the solid material 122 may provide poor wind and air flow properties, cut portions may be used in a part of the solid material or throughout the solid material 122. The cut portions or holes may be incorporated in such a way that they are sufficient to allow wind to pass through the portions and diminish the pressure or force caused by the wind on the nonwoven fabric.

In accordance with this invention, other materials may be used for the solid material 122, such as fabric, polyester, linen, or cotton, or any other material with the properties beneficial for the second panel 120. The second panel 120 may consist of a woven fabric or other cloth or cloth-like material. The second panel 120 may not have mesh openings as may be found in the first panel 110 and open mesh netting 112.

Figure 1C:
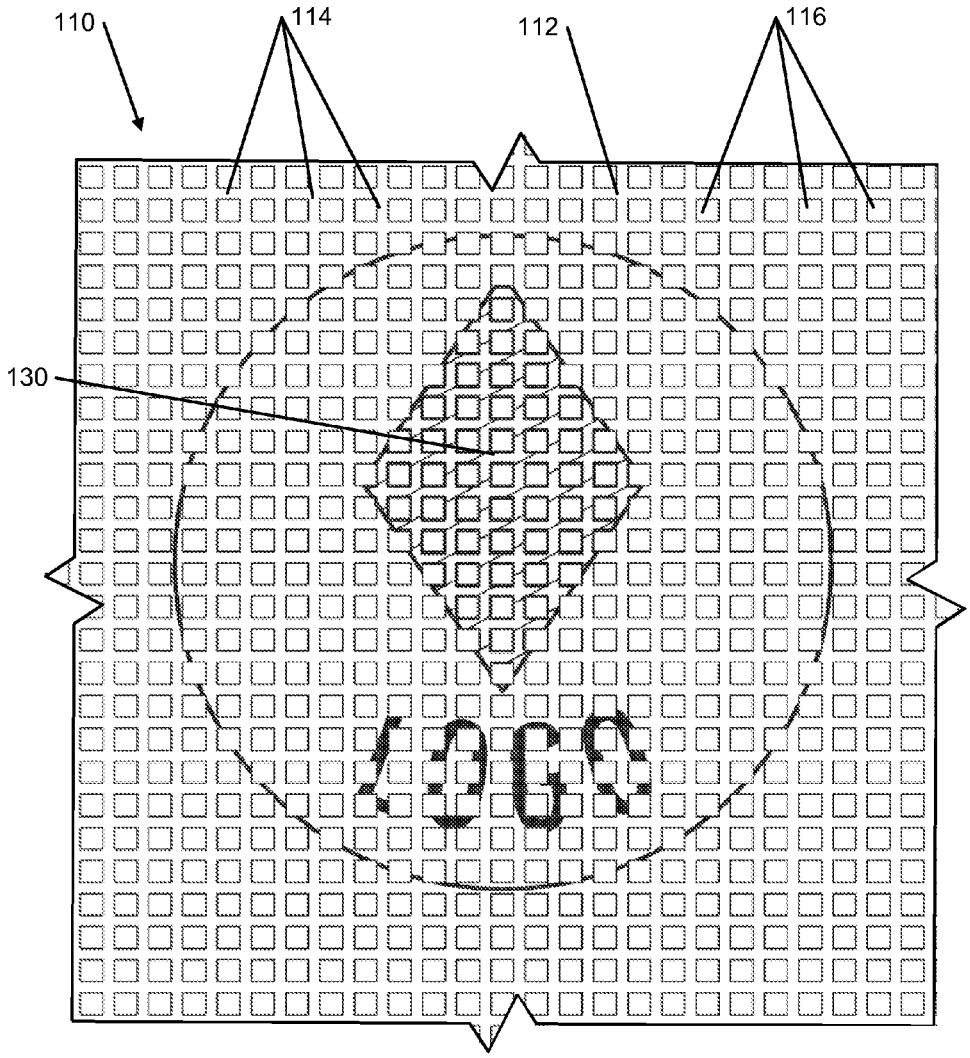
FIG. 1C illustrates a close-up front view of the first panel as shown in FIGS. 1A and 1B2, in accordance with this invention.
Figure 1D:
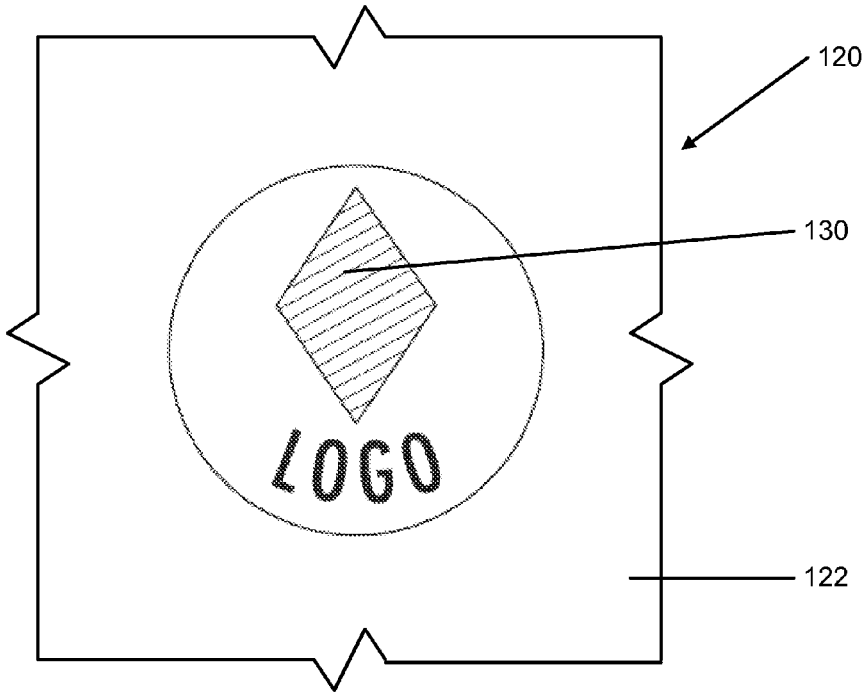
FIG. 1D illustrates a close-up front view of the second panel as shown in FIGS. 1A, 1B1, and 1B2, in accordance with this invention.
Figure 2:
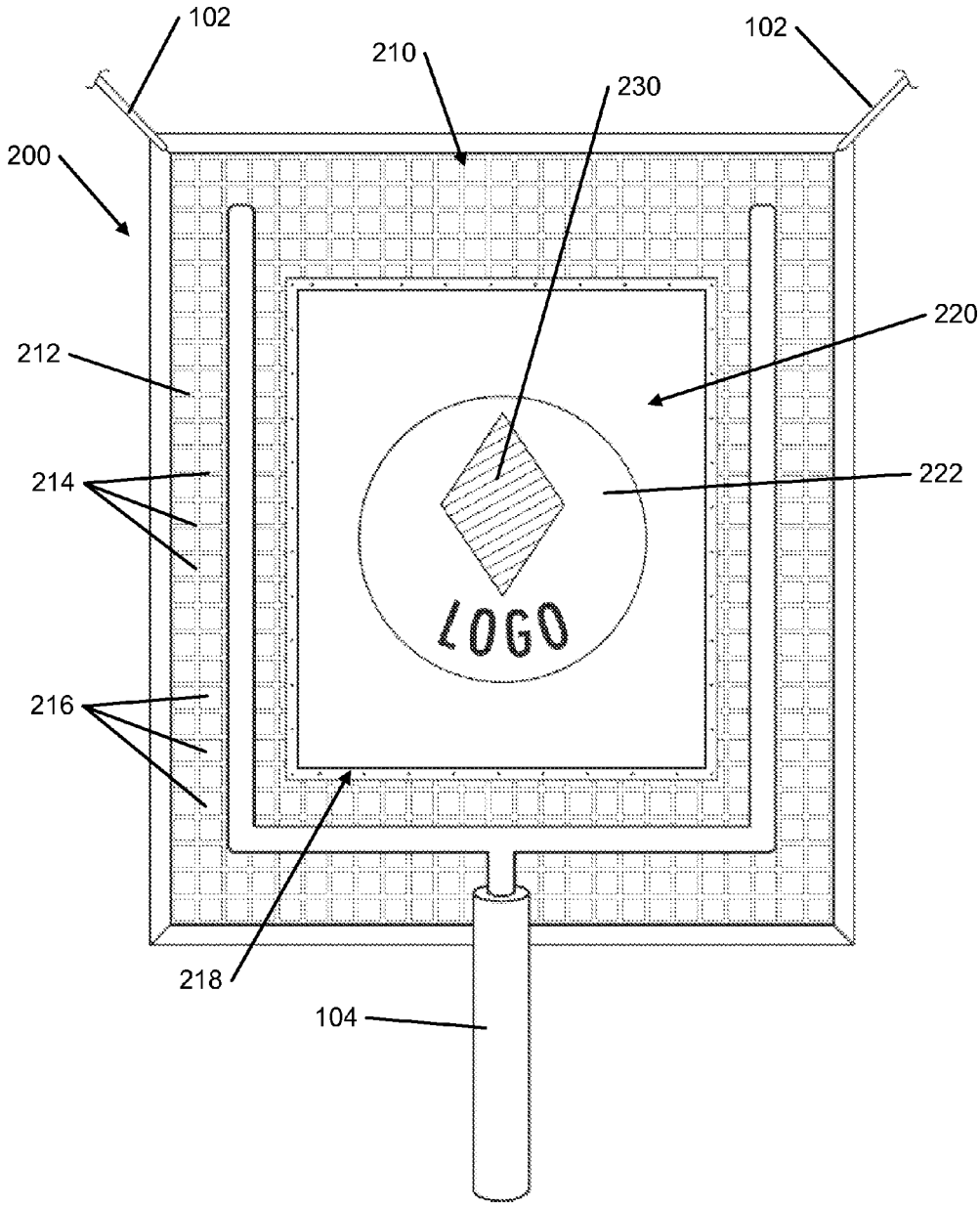

As illustrated in FIGS. 1A through 1D, the first panel 110 and the second panel 120 can be colored or painted with a logo 130 and or words. FIG. 1A illustrates the second panel 120 in front of the first panel 110, wherein the second panel 120 includes the logo 130 and the first panel 110 may or may not include the logo 130. FIGS. 1B1 and 1B2 illustrate the second panel 120 behind the first panel 110, wherein the second panel 120 includes the logo 130 and the first panel 110 may or may not include the logo 130. In the particular embodiment shown in FIG. 1B1, the first panel 110 does not include the logo 130 and the second panel 120 includes the logo 130. In the particular embodiment shown in FIG. 1B2, the first panel 110 includes the logo 130 and the second panel 120 includes the logo 130. FIG. 1C illustrates a close-up view of the first panel 110 with a logo 130 colored or painted onto the first panel 110, which is made up of the mesh netting 112. FIG. 1D illustrates a close-up view of the second panel 120 with a logo 130 colored or painted onto the second panel 120 and solid material 122. In accordance with this invention, a logo 130 may include advertising content, words, pictures, shapes, company logos, sports team logos, messages, or any item that represents another item to be displayed. The logo 130 in the present invention is identified by a diamond shape with the word "LOGO" in the figures. As illustrated in FIGS. 1A through 1D, the shape of the solid material 122 and the second panel 120 is not approximately the same as the shape of the logo 130. In another example in accordance with this invention, the shape of the solid material 122 and the panel 120 may be approximately the same as the shape of the logo 130, such that the shape of the solid material 122 matches the shape of the logo 130. In another embodiment, the shape of the solid material 122 may be slightly larger and in a different shape than the logo 130.

The mesh netting 112 can be colored or painted with the logo 130. Also, the solid material 122 can be colored or painted with the logo 130 in a manner that matches the logo 130 painted on the mesh netting 112. Also, the solid material 122 may not be painted or colored with the logo 130. Moreover, only the solid material 122 may be painted or colored with the logo 130 with the mesh netting 112 not painted or colored with the logo 130. To better improve the contrast with the mesh netting 112, the solid material 122 may be a solid color, such as black or white and the solid material 122 may be a color that is different from the color of the mesh netting 112. In an embodiment, the color of the colored portion of the solid material 122 and color of the colored portion of the mesh netting 112 can be identical to strengthen the visual appearance.

In an embodiment according to this invention, the logo 130 may be colored onto the nonwoven fabric of the solid material 122 by screen printing or bonding. Screen printing generally refers to a method of resin bonding a web of fibers within the nonwoven fabric by using a cylindrical screen. The cylindrical screen, containing a latex resin binder, is rolled and pressed against a moving nonwoven fabric. As the cylinder rotates against the fabric, adhesive binder is squeezed onto the fabric. The binder may then be dried thereby bonding the fabric. An advantage of screen printing or bonding (also referred to as latex printing) is that the amount of binder squeezed onto the fabric can be controlled by the pattern and hole sizes in the screen. Color pigments can be added to the binder, thus coloring and printing the logo 130 on the solid material 122 of the second panel 120 as required.

FIG. 2 illustrates an example according to this invention similar to that described above in conjunction with FIGS. 1A through 1D (the same or similar reference numbers are used in FIG. 2 as those used in FIGS. 1A through 1D to denote the same or similar parts). FIG. 2 illustrates a netting apparatus 200 for use at a sporting event. In another example in accordance with this invention, as shown in FIG. 2, the netting apparatus 200 is generally comprised of a first panel 210 and a second panel 220. The first panel 210 may comprise an open mesh netting 212. The second panel 220 may comprise a solid material 222.

The first panel 210 includes an open mesh netting 212 that may include strands 214 or threads. The strands 214 may consist of textile fibers, metal, plastics, or other materials. The strands 214 define a plurality of mesh openings 216. The mesh openings 216 may be sized such that the open mesh netting 212 is adapted to safely stop a ball or other object without significant obstructions of view through the open mesh netting 212. Additionally, the first panel 210 includes a cut-out portion 218. The cut-out portion 218 may be located in the middle of the first panel 210.

As further illustrated in FIG. 2, the second panel 220 includes a solid material 222. The second panel 220 may be placed into the area of the cut-out portion 218 of the first panel 210, thereby creating one combined panel that includes the mesh netting 212 and the solid material 222. If the cut-out portion 218 is located in the middle of the first panel 210, the combined panel includes the mesh netting 212 around the periphery of the combined panel with the solid material 222 located in the middle of the combined panel. The cut-out portion can be located at a place other than the middle of the first panel. Additionally, the second panel 220 may be attached to the first panel 210 by a variety of methods such as sewn together, clipped with fasteners, glued, or any other similar method used to attach the first panel 210 to the second panel 220. When attached to each other, the first panel 210 and the second panel 220 may not overlap with each other. The second panel 220 may be see-through, such that the spectators are able to view the sporting event or sports activities through the second panel 220 when the second panel 220 is in position. The second panel 220 may also be not see-through, such that the spectators are not able to view or are not able to significantly view the sporting event or sports activities through the second panel 220 when the second panel 220 is in position.

As illustrated in FIG. 2, the solid material 222 is colored or painted with a logo 230. The mesh netting 212 may or may not be colored or painted with the logo 230 in accordance with this invention. As described above, the solid material 222 of the second panel 220 may consist of a nonwoven fabric, polyester, linen, or cotton, woven fabric, cloth or any other material with the properties beneficial for the second panel 220.

Figure 3A:
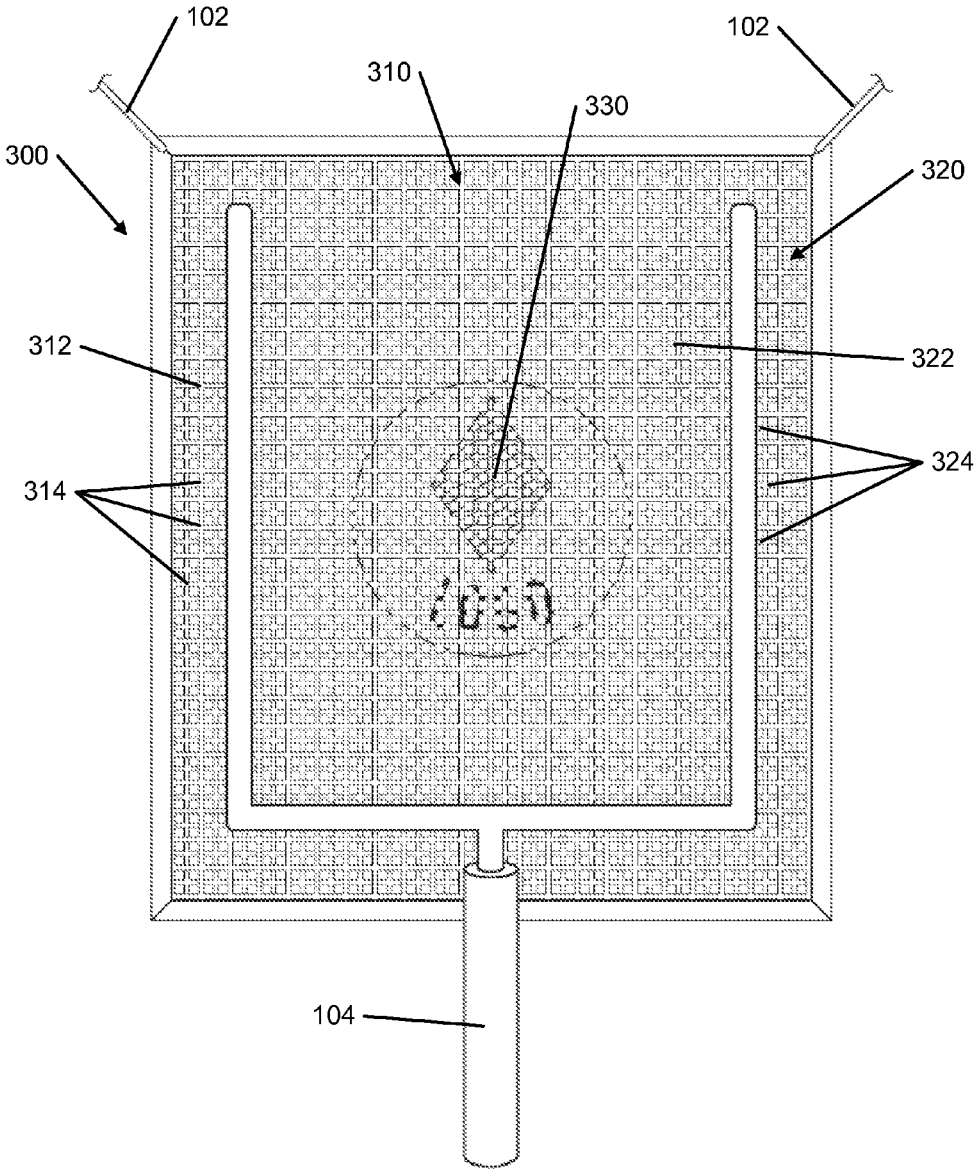
FIG. 3A illustrates a front plan view of another example netting apparatus in accordance with this invention.
Figure 3B:
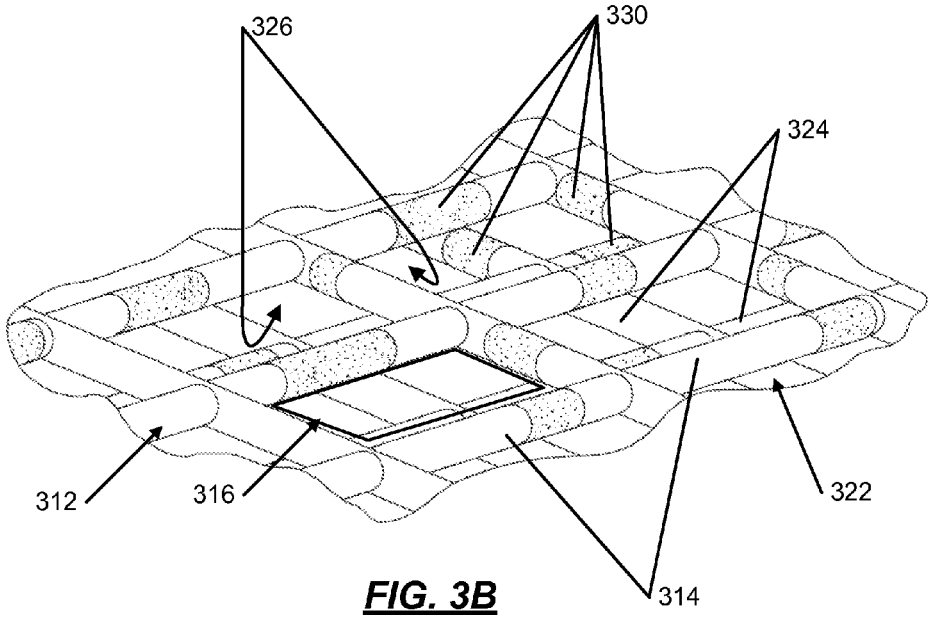
FIG. 3B illustrates a close-up perspective view of the netting apparatus as shown in FIG. 3A in accordance with this invention.

FIGS. 3A and 3B illustrate an example according to this invention similar to that described above in conjunction with FIGS. 1A through 1D (the same or similar reference numbers are used in FIGS. 3A and 3B as those used in FIGS. 1A through 1D to denote the same or similar parts). FIG. 3A illustrates a netting apparatus 300 for use at a sporting event. In another example in accordance with this invention, as shown in FIG. 3A, the netting apparatus 300 is generally comprised of a first net 310 and a second net 320. The first net 310 may comprise a first mesh netting 312. The second net 320 may also comprise a second mesh netting 322.

The first net 310 includes the first mesh netting 312 that may include strands 314 or threads. The strands 314 may consist of textile fibers, metal, plastics, or other materials. The strands 314 define a plurality of mesh openings 316. The mesh openings 314 may be sized such that the first mesh netting 312 is adapted to safely stop a ball or other object without significant obstructions of view through the first mesh netting 312.

The second net 320 includes the second mesh netting 322 that may include strands 324 or threads. The strands 324 may consist of textile fibers, metal, plastics, or other materials. The strands 324 define a plurality of mesh openings 326. The mesh openings 326 may be sized such that the second mesh netting 322 is adapted to safely stop a ball or other object without significant obstructions of view through the second mesh netting 322. Additionally, the mesh openings 316 of the first panel 310 may be exactly the same size as the mesh openings 326 of the second panel 320.

As shown in FIG. 3A, the second net is located either in front of or behind the first net in an offset manner. FIG. 3B illustrates a close-up perspective view showing the offset manner of the first net 310 and the second net 320. In the offset manner, the strands 314, 324 and the mesh openings 316, 326 of the first net 310 and the second net 320 do not match up perfectly. As shown in FIGS. 3A and 3B, the strands 314 from the first net 310 cover the mesh openings 326 from the second net 320, while the strands 324 from the second net 320 cover the mesh openings 316 from the first net 310. The second net 320 may be attached to the first net 310 by a variety of methods such as sewn together, clipped with fasteners, glued or any other similar method used to attach the first net 310 to the second net 320.

As illustrated in FIGS. 3A and 3B, the first net 310 and the second net 320 can be colored or painted with a logo 330. By off-setting the first net 310 and the second net 320, more surface area is created for the paint and/or coloring so that the logo 330 can be better viewed by the spectators. A third net and or a fourth net that is/are painted or colored similar to the first net 310 and the second net 320 can be further added in an offset manner to an overall system of nets.

Figure 4:
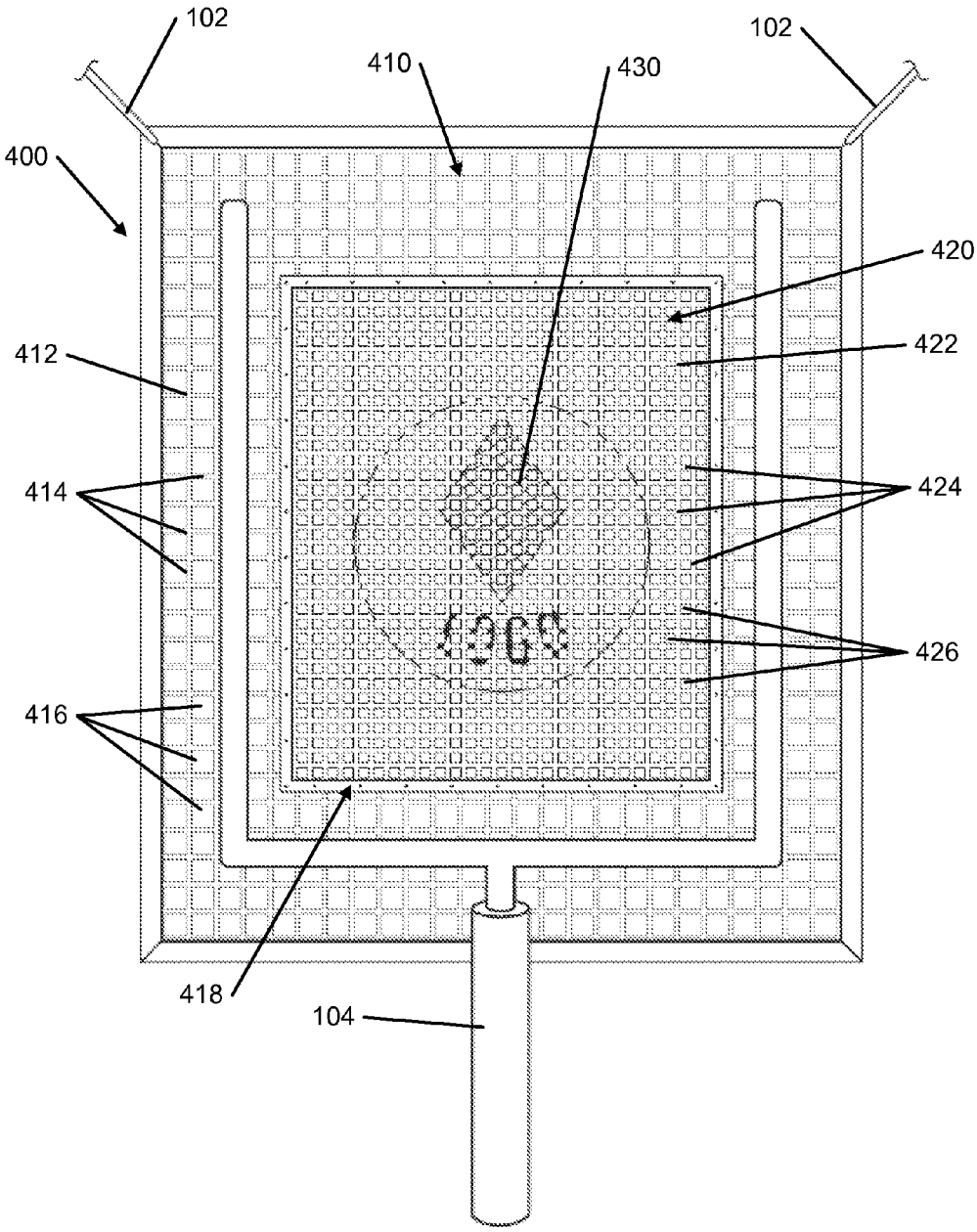
FIG. 4 illustrates a front plan view of another example netting apparatus in accordance with this invention.

FIG. 4 illustrates an example according to this invention similar to that described above in conjunction with FIGS. 1A through 1D (the same or similar reference numbers are used in FIG. 4 as those used in FIGS. 1A through 1D to denote the same or similar parts). FIG. 4 illustrates a netting apparatus 400 for use at a sporting event. In another example in accordance with this invention, as shown in FIG. 4, the netting apparatus 400 is generally comprised of a first net 410 and a second net 420. The first net 410 may comprise a first mesh netting 412. The second net 420 may also comprise a second mesh netting 422.

The first net 410 includes the first mesh netting 412 that may include strands 414 or threads. The strands 414 may consist of textile fibers, metal, plastics, or other materials. The strands 414 define a plurality of mesh openings 416. The mesh openings 416 may be sized such that the first mesh netting 412 is adapted to safely stop a ball or other object without significant obstructions of view through the first mesh netting 412. Additionally, the first net 410 includes a cut-out portion 418. The cut-out portion 418 may be located in the middle of the first net 410 or at another location of the first net.

The second net 420 includes the second mesh netting 422 that may include strands 424 or threads. The strands 424 may consist of textile fibers, metal, plastics, or other materials. The strands 424 define a plurality of mesh openings 426. The mesh openings 426 may be sized such that the second mesh netting 422 is adapted to safely stop a ball or other object without significant obstructions of view through the second mesh netting 422. The mesh openings 426 of the second net 420 are smaller than the mesh openings 416 of the first net 410.

The second net 420 may be placed into the area of the cut-out portion 418 of the first net 410, thereby creating one combined net that includes the first net 410 and the second net 420. If the cut-out portion 418 is located in the middle of the first net 410, the combined net includes the first net 410 with the first-sized mesh openings 416 around the periphery of the combined net with the second net 420 with the second-sized mesh openings 426 located in the middle of the combined net. Additionally, the second net 420 may be attached to the first net 410 by a variety of methods such as sewn together, clipped with fasteners, glued, or any other similar method used to attach the first net to the second net. When attached to each other, the first net 410 and the second net 420 may not overlap with each other.

As shown in FIG. 4, the second net 420 is colored or painted with a logo 430. The smaller-sized mesh openings 426 of the second net 420 thereby provide more surface area for the paint and/or coloring so that the logo 430 can be better viewed by the spectators. The first net 410 may or may not be colored or painted with the logo 430 in accordance with this invention.

CONCLUSION

The present invention is disclosed above and in the accompanying drawings with reference to a variety of examples. The purpose served by the disclosure, however, is to provide an example of the various features and concepts related to the invention, not to limit the scope of the invention. One skilled in the relevant art will recognize that numerous variations and modifications may be made to the aspects described above without departing from the scope of the present invention, as defined by the appended claims.

We claim:

1. A net apparatus adapted to display advertising content at a sporting event, the net apparatus comprising:

a first net having a first mesh netting with strands which define a plurality of first-sized mesh openings;

a second net having a second mesh netting with strands which define a plurality of second-sized mesh openings, wherein the first-sized mesh openings are the same size as the second-sized mesh openings;

a third net having a third mesh netting with strands which define a plurality of third-sized mesh openings; and a fourth net having a fourth mesh netting with strands which define a plurality of fourth-sized mesh openings, wherein the second net is located either in front of or behind the first net in an offset manner, such that the strands from the first net partially cover the mesh openings from the second net and the strands from the second net partially cover the mesh openings from the first net, wherein the first net and the second net are colored or painted with a logo, and wherein the first mesh netting and the second mesh netting are adapted to safely stop a ball without significant obstruction of view through the mesh nettings.

2. A net apparatus according to claim 1, wherein the first net and the second net are painted on a first side and at least partially painted on a second side opposite the first side.

3. A net apparatus according to claim 1, wherein the second net is attached to the first net.

4. A net apparatus according to claim 1, wherein the third net is located either in front of or behind the first net in an offset manner, such that the strands from the first net partially cover the mesh openings from the third net and the strands from the third net partially cover the mesh openings from the first net.

5. A net apparatus according to claim 1, wherein the third net is colored or painted with a logo.

6. A net apparatus according to claim 1, wherein the third net is attached to the first net or the second net.

7. A net apparatus according to claim 1, wherein the fourth net is located either in front of or behind one of the first net, the second net, or the third net in an offset manner, such that the strands from one of the first net, the second net, or the third net partially cover the mesh openings from the fourth net and the strands from the fourth net partially cover the mesh openings from one of the first net, the second net, or the third net.

8. A net apparatus according to claim 1, wherein the fourth net is colored or painted with a logo.

9. A net apparatus according to claim 1, wherein the fourth net is attached to one or more of the first net, the second net, or the third net.

10. A sports blocking and display apparatus comprising:

a first net having a first mesh netting with strands which define a plurality of first-sized mesh openings;

a second net having a second mesh netting with strands which define a plurality of second-sized mesh openings, wherein the first-sized mesh openings are the same size as the second-sized mesh openings, wherein the second net is located either in front of or behind the first net in an offset manner, such that the strands from the first net partially cover the mesh openings from the second net and the strands from the second net partially cover the mesh openings from the first net;

a third net having a third mesh netting with strands which define a plurality of third-sized mesh openings, wherein the third net is located either in front of or behind the first net in an offset manner, such that the strands from the first net partially cover the mesh openings from the third net and the strands from the third net partially cover the mesh openings from the first net; and a fourth net having a fourth mesh netting with strands which define a plurality of fourth-sized mesh openings, wherein the first net, the second net, and the third net are colored or painted with a logo, and wherein the first mesh netting, the second mesh netting, and the third mesh netting, and the fourth net are adapted to safely stop a ball without significant obstruction of view through the mesh nettings.

11. A net apparatus according to claim 10, wherein the first net, the second net, and the third net are painted on a first side and at least partially painted on a second side opposite the first side.

12. A net apparatus according to claim 10, wherein the fourth mesh netting is adapted to safely stop a ball without significant obstruction of view through the mesh netting.

13. A net apparatus according to claim 10, wherein the fourth net is located either in front of or behind one of the first net, the second net, or the third net in an offset manner, such that the strands from one of the first net, the second net, or the third net partially cover the mesh openings from the fourth net and the strands from the fourth net partially cover the mesh openings from one of the first net, the second net, or the third net.

14. A net apparatus according to claim 10, wherein the fourth net is colored or painted with a logo.

15. A net apparatus according to claim 10, wherein the fourth net is attached to one or more of the first net, the second net, or the third net.

16. A net apparatus adapted to display advertising content at a sporting event, the net apparatus comprising:

a first net having a first mesh netting with strands which define a plurality of first-sized mesh openings;

a second net having a second mesh netting with strands which define a plurality of second-sized mesh openings, wherein the first-sized mesh openings are a different size than the second-sized mesh openings;

a third net having a third mesh netting with strands which define a plurality of third-sized mesh openings, wherein the third net is located either in front of or behind the first net in an offset manner, such that the strands from the first net partially cover the mesh openings from the third net and the strands from the third net partially cover the mesh openings from the first net; and a fourth net having a fourth mesh netting with strands which define a plurality of fourth-sized mesh openings, wherein the fourth net is located either in front of or behind one of the first net, the second net, or the third net in an offset manner, such that the strands from one of the first net, the second net, or the third net partially cover the mesh openings from the fourth net and the strands from the fourth net partially cover the mesh openings from one of the first net, the second net, or the third net, wherein the second net is located either in front of or behind the first net in an offset manner, such that the strands from the first net partially cover the mesh openings from the second net and the strands from the second net partially cover the mesh openings from the first net, wherein the first net and the second net are colored or painted with a logo on a first side and at least partially painted on a second side opposite the first side, and wherein the first mesh netting and the second mesh netting are adapted to safely stop a ball without significant obstruction of view through the mesh nettings.

17. A net apparatus according to claim 16, wherein the second net is attached to the first net by sewing the first net to the second net.

* * * * *